US011326411B2

(12) United States Patent
Duggan et al.

(10) Patent No.: US 11,326,411 B2
(45) Date of Patent: May 10, 2022

(54) THERMAL ACTIVATION OF LINER HANGER FOR ELASTOMER-LESS COMPLETION

(71) Applicants: Andrew Duggan, Houston, TX (US); Jeffrey C. Williams, Cypress, TX (US)

(72) Inventors: Andrew Duggan, Houston, TX (US); Jeffrey C. Williams, Cypress, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/444,943

(22) Filed: Jun. 18, 2019

(65) Prior Publication Data

US 2020/0399991 A1 Dec. 24, 2020

(51) Int. Cl.

| | |
|---|---|
| ***E21B 23/01*** | (2006.01) |
| ***E21B 43/10*** | (2006.01) |
| ***E21B 33/04*** | (2006.01) |
| ***E21B 36/00*** | (2006.01) |

(52) U.S. Cl.

CPC ..... *E21B 23/01* (2013.01); *E21B 33/04* (2013.01); *E21B 33/0422* (2013.01); *E21B 36/00* (2013.01); *E21B 43/10* (2013.01); *E21B 43/105* (2013.01)

(58) Field of Classification Search

CPC ..... E21B 43/105; E21B 23/01; E21B 33/04; E21B 43/10; E21B 33/0422; E21B 36/00

See application file for complete search history.

(56) References Cited

U.S. PATENT DOCUMENTS

| | | | | |
|---|---|---|---|---|
| 4,640,354 | A * | 2/1987 | Boisson | E21B 27/02 166/162 |
| 4,669,538 | A * | 6/1987 | Szarka | E21B 23/06 166/120 |
| 5,197,671 | A | 3/1993 | Wass et al. | |
| 5,346,014 | A | 9/1994 | Ross | |
| 5,558,153 | A | 9/1996 | Holcombe et al. | |
| 5,560,426 | A * | 10/1996 | Trahan | E21B 23/04 166/120 |
| 5,819,854 | A * | 10/1998 | Doane | E21B 23/00 166/373 |
| 6,216,779 | B1 * | 4/2001 | Reinhardt | E21B 17/1021 166/57 |

(Continued)

OTHER PUBLICATIONS

International Search Report for International Application No. PCT/US2020/032466; International Filing Date May 12, 2020; dated Aug. 20, 2020, 10 pages.

*Primary Examiner* — Nicole Coy
(74) *Attorney, Agent, or Firm* — Cantor Colburn LLP

(57) ABSTRACT

An apparatus and method for placing a member in a wellbore. The apparatus includes member conveyable downhole, a component of the member configured to perform an action in the wellbore, a potential energy source, a locking device and a heat source. The potential energy source is capable of activating the component. The locking device constrains the potential energy source from activating the component when the locking device is in a first state. The heat source changes the locking device from the first state to a second state in which the locking device allows the potential energy source to activate the component.

12 Claims, 2 Drawing Sheets

(56) References Cited

U.S. PATENT DOCUMENTS

| | | | | |
|---|---|---|---|---|
| 6,431,277 | B1 * | 8/2002 | Cox | E21B 23/01 166/208 |
| 7,546,872 | B2 * | 6/2009 | McGilvray, Jr. | E21B 33/0422 166/208 |
| 7,624,797 | B2 * | 12/2009 | Fay | F03G 7/065 166/215 |
| 7,832,474 | B2 * | 11/2010 | Nguy | E21B 17/06 166/242.6 |
| 7,909,088 | B2 * | 3/2011 | O'Malley | E21B 34/06 166/53 |
| 8,893,807 | B2 * | 11/2014 | Tait | E21B 23/00 166/382 |
| 9,447,655 | B2 * | 9/2016 | Zhao | E21B 33/04 |
| 9,624,744 | B2 * | 4/2017 | Gerrard | E21B 23/00 |
| 10,301,914 | B2 * | 5/2019 | Zhao | E21B 33/04 |
| 2007/0144731 | A1 | 6/2007 | Murray et al. | |
| 2009/0314497 | A1 | 12/2009 | Johnson | |
| 2013/0062049 | A1 | 3/2013 | Ren et al. | |
| 2016/0084018 | A1 | 3/2016 | Allen | |

* cited by examiner

THERMAL ACTIVATION OF LINER HANGER FOR ELASTOMER-LESS COMPLETION

BACKGROUND

In the resource recovery industry, a liner hanger is used in a wellbore to attach a liner to a support structure such as a casing. Conventional liner hangers are activated using hydraulic cylinders, which presents potential leak paths for the future of the liner hanger during wellbore production.

SUMMARY

In an embodiment, an apparatus for use in a wellbore is disclosed. The apparatus includes: a member conveyable downhole, a component of the member configured to perform an action in the wellbore, a potential energy source for activating the component, a locking device and a heat source. The locking device constrains the potential energy source from activating the component when the locking device is in a first state. The heat source changes the locking device from the first state to a second state in which the locking device allows the potential energy source to activate the component In another embodiment, a method of placing a member in a wellbore is disclosed. The member is run downhole. The member includes a potential energy source for activating the component and a locking device in a first state. In the first state, the locking device constrains the potential energy source from activating the component. Heat is applied to the locking device from a running tool in a bore of the member to change the locking device from the first state to a second state to allow the potential energy source to activate the component.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
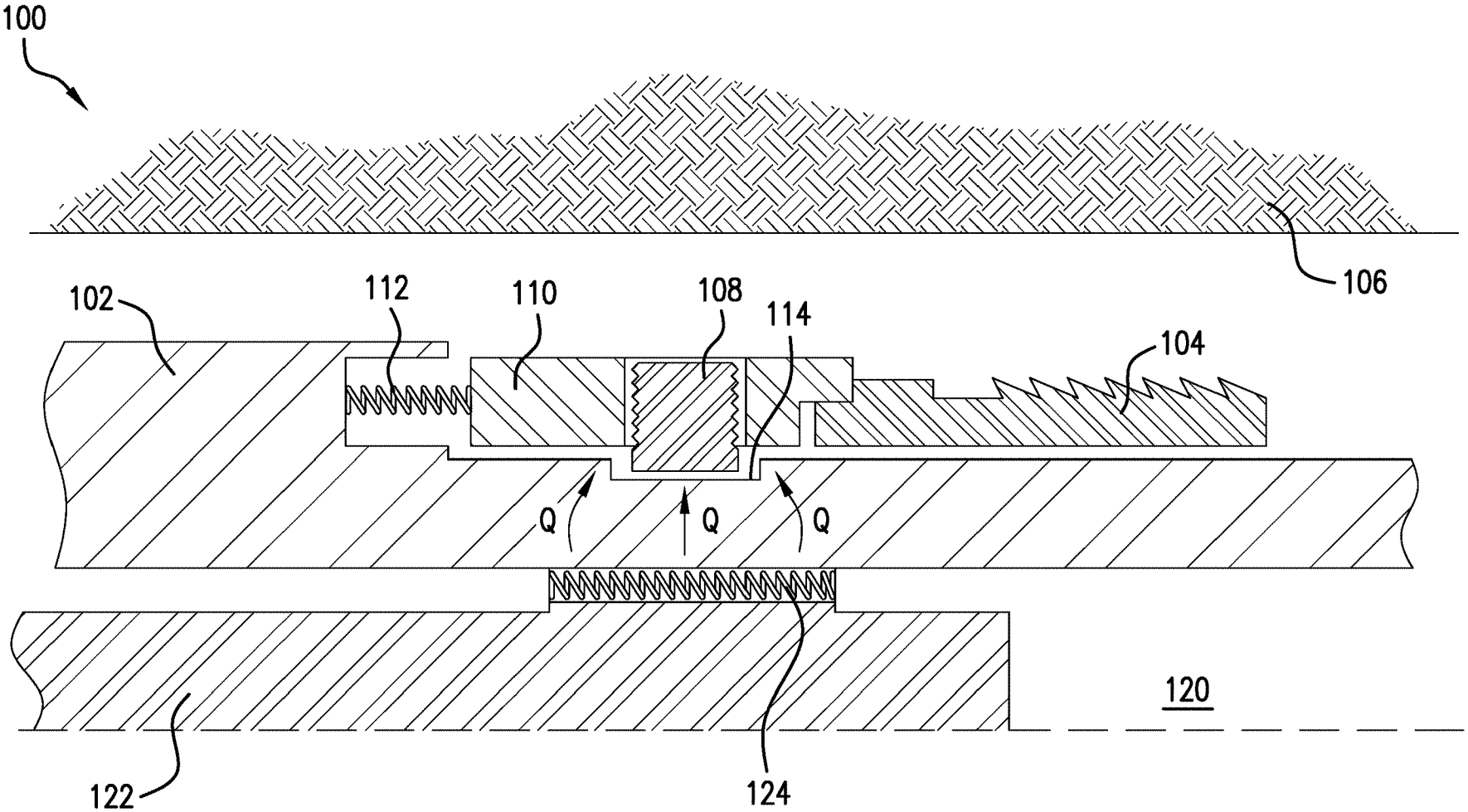
FIG. 1 shows a downhole member in a section a wellbore in an embodiment.

Referring to FIG. 1, a section 100 of a wellbore is shown for illustrative purposes. The section 100 shows a downhole member 102 or apparatus disposed in the wellbore. In various embodiments, the member 102 is a liner that is to be disposed within the wellbore at a selected location. In other embodiments, the member 102 can be, but is not limited to, tubular member such as a string, etc., having a longitudinal axis. The downhole member 102 includes a component 104 that can be actuated to perform an action using the methods disclosed herein. In various embodiments, the component 104 is a liner hanger that, when actuated, moves from a first location of the member 102 to a second location of the member by moving along an outer surface of the member. At the first location, the component 104 is in an unset position and, at the second location, the component is in a set position. Moving the component 104 from the first position to the second position generally includes moving the component along a longitudinal axis of the member 102 but can also include extending at least a portion of the component 104 radially outward to engage a casing 106 or other support member in order to hang the member 102 within the casing or support member. In other embodiments, the component 104 can be a seal, a sleeve, slip, port cover, etc.

The component 104 is located at an outer surface of the member 102. Also disposed on the outer surface is a locking device 108, a lock housing 110 and a potential energy source 112. In various embodiments, the component 104 and the lock housing 110 can be the same part. The potential energy source 112 can be, for example, a spring, a hydraulic device, a magnet, or any other source of energy that is arranged in a configuration for providing mechanical energy for actuating the component 104. In one embodiment, the potential energy source 112 is a spring that is loaded on the member 102 in a compressed state. The locking device 108 secures the lock housing 110 at a selected location of the member 102 between the potential energy source 112 and the component 104. The lock housing 110 mechanically connects the potential energy source 112 to the component 104. In the secured position, at the selected location, the lock housing 110 contains or maintains the spring in its compressed state. In various embodiments, the potential energy source 112, lock housing 110 and component 104 are aligned along the longitudinal axis of the member 102.

In various embodiments, the locking device 108 is a shear screw or a shear pin. The locking device passes through a passage or opening in the lock housing 110 and into a groove, pit or recess 114 in the outer surface of the member 102 in order to secure the lock housing to the member 102. The passage or opening of the lock housing 110 and/or the recess 114 can be threaded in order to attach the shear screw to the lock housing 110 and/or member 102, respectively. The locking device can be made of material that changes from a first state to a second state upon application of heat. In particular, the locking device is made of a material that melts or weakens when heated to or above a specified temperature. The locking device 108 therefore constrains the potential energy source 112 from activating the component 104 when in a first state or solid state or rigid state. Heating the locking device 108 changes the locking device from the first state to a second state which is more pliable and in which the locking device allows the potential energy source 112 to activate the component 104. In various embodiments, the shear screw is made of brass, but is not limited to any particular metal or alloy. In various embodiments, the locking device 108 can be a memory shape polymer or memory shape metal. When heated, the memory shape polymer or metal deforms from a first shape which holds the locking device 108 in place to a second shape which unlocks the locking device and allows the potential energy source 112 to move the component 104.

The member 102 further includes a longitudinal bore 120 therethrough. A running tool 122 can be run through the bore 120. The running tool 122 includes a heating device 124 or heater that is run through the bore 120 to an axial location of the locking device 108 as shown in FIG. 1. In various embodiments, the heating device 124 can be a resistive coil that heats up when an electrical current is run through it. In other embodiments, the heat source can be a different source such as a source of chemical reaction. The heating device 124 can be attached to a power source (not shown) that is controlled by a switch or processor. The power source can be located either at a surface location or on the running tool 122.

In order to activate the component 104, the running tool 122 is run through the bore 120 in order to place the heating device 124 at the axial location of the locking device 108. The running tool 122 can be run downhole at the same time as the member 102 is run downhole or after the member is in its place downhole, in various embodiments. The heating device 124 is then activated in order to generate heat Q. The heat passes through the member 102 from the bore 120 to the outer surface of the member 102. The heat is then absorbed at the locking device 108 causing its temperature to rise to or above a selected temperature, thereby causing the locking device 108 to dissolve, melt, or partially melt, weaken or deform. Once the locking device 108 has dissolved, deformed, or weakened to a sufficient amount, the spring decompresses, pushing against the lock housing 110 which, in turn, pushes against the component 104. The spring is aligned with the longitudinal axis of the member 102 therefore allowing the component 104 to move axially along the outer surface from the first (unengaged) location to the second (engaged) location.

Figure 2:
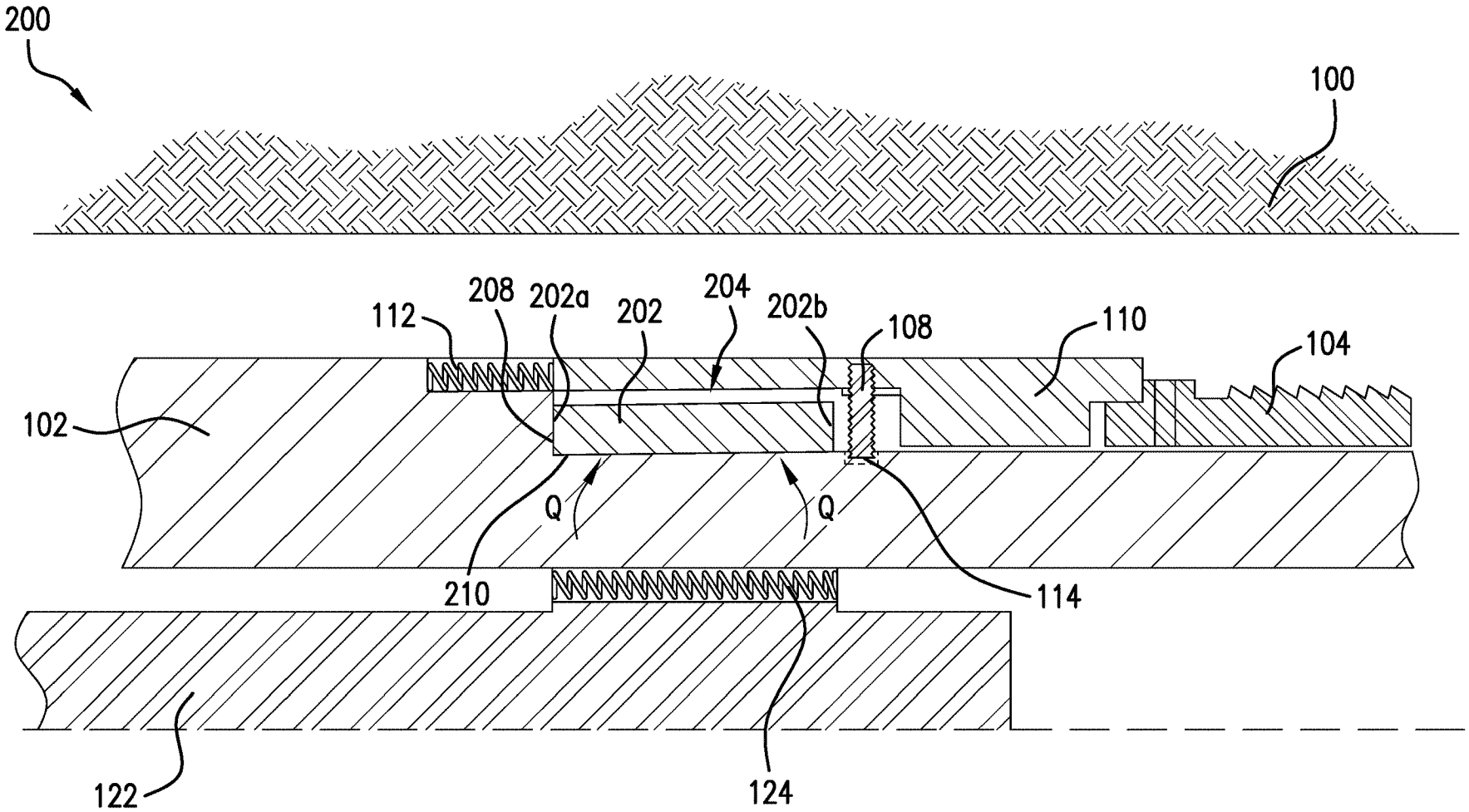
FIG. 2 shows an alternate embodiment of the downhole member.

FIG. 2 shows a second embodiment of the downhole member 102. The downhole member 102 includes component 104, locking device 108, lock housing 110 and potential energy source 112 on its outer surface. The locking device 108 secures the lock housing 110 at a selected location of the member 102 between the potential energy source 112 and the component 104. In various embodiments, the component 104 and the lock housing 110 can be the same part. The lock housing 110 mechanically connects the potential energy source 112 to the component 104. In the secured position at the selected location, the lock housing 110 contains or maintains the spring in its compressed state. The locking device 108 can be a shear screw that is installed through a passage or hole in the lock housing 110 and into a groove, pit or recess 114 in the outer surface of the member 102. The passage of the lock housing 110 and/or the recess 114 can be threaded in order to secure the locking device in place.

When secured to the member 102 by the locking device 108, the lock housing 110 and the outer surface 210 of the member 102 form a chamber 204. The sides of the chamber 204 are defined by a ridge 208 formed in the outer surface of the member 102 and the locking device 108. The ridge 208 is a rigid boundary that can be a part of member 102 or can be a separate piece attached to member 102. In the embodiment shown in FIG. 2, the ridge 208 is a part of member 102. The chamber 204 holds a shear device 202 in a tightly confined space. The shear device 202 is a bar or other structure having a high coefficient of thermal expansion relative to the materials of the surrounding components. When in an unheated state, a first end 202*a* of the shear device 202 is proximate the ridge 208 in the outer surface of the member 102 and a second end 202*b* of the shear device is proximate the locking device 108. The second end 202*b* is opposite the first end 202*a*. When heated, the shear device 202 expands along the longitudinal axis of the member 102 in order to break or shear the locking device 108, thereby releasing the lock housing 110 from the member 102. With the lock housing 110 free from the member 102, the potential energy source 112 pushes the lock housing in order to move the component 104 from a first location to a second location.

While the locking device 108 is broken due to thermal expansion of the shear device 202, the locking device 108 can further be made of a material that melts or weakens when brought to a specified temperature. Additionally, a length or dimension of the shear device 202 can be selected so as to break the locking device 108 at a specified temperature.

The member 102 further includes a longitudinal bore 120 through which a running tool 122 including a heating device 124 can be run. The running tool 122 can be run downhole at the same time as the member 102 is run downhole or after the member is in its place downhole, in various embodiments. To activate the component 104, the running tool 122 is run through the bore 120 to place the heating device 124 at the axial location of the shear device 202. The heating device 124 is then activated in order to generate heat which passes through the member 102 and is absorbed by the shear device 202, expanding the shear device to break, or deform the locking device 108, thereby releasing the lock housing and allowing the potential energy source to move the component 104 from the first location to the second location.

Although the apparatus disclosed herein is configured for moving the component 104 along a longitudinal axis of the member 102, the apparatus can be configured to moving the component along a circumference of the member as well as in a radial direction, in alternate embodiments.

Set forth below are some embodiments of the foregoing disclosure:

Embodiment 1. An apparatus for use in a wellbore. The apparatus includes: a member conveyable downhole; a component of the member configured to perform an action in the wellbore; a potential energy source of the member for activating the component; a locking device that, in a first state, constrains the potential energy source from activating the component; and a heat source that changes the locking device from the first state to a second state, wherein the locking device in the second state allows the potential energy source to activate the component.

Embodiment 2. The apparatus of any prior embodiment, wherein the potential energy source is at least one of: (i) a spring; (ii) a hydraulic device; (iii) a magnet.

Embodiment 3. The apparatus of any prior embodiment, wherein the locking device is one of a shear screw and a shear pin.

Embodiment 4. The apparatus of any prior embodiment, wherein the first state of the shear pin is as a solid state and the second state of the shear pin is at least a weakened, deformed or partially melted state.

Embodiment 5. The apparatus of any prior embodiment, further comprising a shear device configured to expand to break or deform the locking device upon being heated to or above a specified temperature.

Embodiment 6. The apparatus of any prior embodiment, wherein the potential energy source activates the component by moving the component from a first location of the member to the second location of the member.

Embodiment 7. The apparatus of any prior embodiment, wherein the first location is separated from the second location by one of: (i) axially; (ii) circumferentially; and (iii) radially.

Embodiment 8. The apparatus of any prior embodiment, wherein the component is a liner hanger that engages the member to a casing in the wellbore when activated.

Embodiment 9. The apparatus of any prior embodiment, wherein the locking device is made of a memory shape polymer or memory shape metal that deforms from a first shape to a second shape to allow the potential energy source to move the component.

Embodiment 10. A method of placing a member in a wellbore. The method includes: running the member downhole, the member including a component for engaging the member in the wellbore, a potential energy source for activating the component and a locking device in a first state, wherein the locking device in the first state constrains the potential energy source from activating the component; and applying heat to the locking device from a running tool in a bore of the member to change the locking device from the first state to a second state to allow the potential energy source to activate the component.

Embodiment 11. The method of any prior embodiment, wherein the potential energy source is at least one of: (i) a spring; (ii) a hydraulic device; (iii) a magnet.

Embodiment 12. The method of any prior embodiment, wherein the locking device is one of a shear screw and shear pin.

Embodiment 13. The method of any prior embodiment, wherein the first state of the shear pin is a solid state and the second state of the shear pin is at least a weakened, deformed or partially melted state.

Embodiment 14. The method of any prior embodiment, further comprising heating a thermally expansive shear device to expand the shear device to break or deform the locking device.

Embodiment 15. The method of any prior embodiment, wherein activating the component further comprises moving the component from a first location of the member to the second location of the member.

Embodiment 16. The method of any prior embodiment, wherein the first location of the member is separated from the second location of the member by one of: (i) axially; (ii) circumferentially; and (iii) radially.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for use in a wellbore, comprising:

a member conveyable downhole, the member including a bore therethrough and a recess on an outer surface of the member;

a component of the member configured to perform an action in the wellbore;

a potential energy source of the member for activating the component;

a lock housing;

a locking device that fits in the recess in a solid state to constrain the potential energy source from activating the component, wherein the locking device, the lock housing and an outer surface of the member define a chamber;

a shear device in the chamber configured to expand to break or deform the locking device upon being heated to or above a specified temperature; and a heat source configured to be run through the bore to an axial location of the locking device and to be activated at the axial location to generate heat that passes through the member to heat the shear device to or above the specified temperature to expand the shear device to break or deform the locking device, wherein the locking device in the broken or deformed state allows the potential energy source to activate the component.

2. The system of claim 1, wherein the potential energy source is at least one of: (i) a spring; (ii) a hydraulic device; (iii) a magnet.

3. The system of claim 1, wherein the locking device is one of a shear screw and a shear pin.

4. The system of claim 1, wherein the potential energy source activates the component by moving the component from a first location of the member to a second location of the member.

5. The system of claim 4, wherein the first location is separated from the second location by one of: (i) axially; (ii) circumferentially; and (iii) radially.

6. The system of claim 1, wherein the component is a liner hanger that engages the member to a casing in the wellbore when activated.

7. The system of claim 1, wherein the locking device is made of a memory shape polymer or memory shape metal that deforms from a first shape to a second shape to allow the potential energy source to move the component.

8. A method of placing a member in a wellbore, comprising:

running the member downhole, the member including a bore therethrough, a recess on an outer surface of the member, a component for engaging the member in the wellbore, a potential energy source for activating the component, a lock housing, a locking device in a solid state that fits in the recess to constrain the potential energy source from activating the component, wherein the lock housing, the locking device and an outer surface of the member define a chamber, and a thermally expansive shear device in the chamber;

running a heat source through the bore to an axial location of the locking device; and activating the heat source at the axial location to generate heat that passes through the member to the thermally expansive shear device to expand the thermally expansive shear device to break or deform the locking device, thereby allowing the potential energy source to activate the component.

9. The method of claim 8, wherein the potential energy source is at least one of: (i) a spring; (ii) a hydraulic device; (iii) a magnet.

10. The method of claim 8, wherein the locking device is one of a shear screw and shear pin.

11. The method of claim 8, wherein activating the component further comprises moving the component from a first location of the member to a second location of the member.

12. The method of claim 11, wherein the first location of the member is separated from the second location of the member by one of: (i) axially; (ii) circumferentially; and (iii) radially.

* * * * *